US005719465A

United States Patent [19]

Den Breeijen et al.

[11] Patent Number: 5,719,465

[45] Date of Patent: Feb. 17, 1998

[54] LOW PRESSURE MERCURY VAPOR DISCHARGE LAMP

[75] Inventors: Peter M. Den Breeijen, Roosendaal; Franciscus A. S. Ligthart; Patricius W. M. Lepelaars, both of Eindhoven, all of Netherlands

[73] Assignee: U.S. Philips Corporation, New York, N.Y.

[21] Appl. No.: 574,796

[22] Filed: Dec. 19, 1995

[30] Foreign Application Priority Data

Dec. 20, 1994 [EP] European Pat. Off. ..... 94203689

[51] Int. Cl.[6] ..... H01J 1/62

[52] U.S. Cl. ..... 313/490; 313/493; 313/565

[58] Field of Search ..... 313/490, 492, 313/571, 637, 639, 577, 552, 550, 565, 609, 610, 611, 608

[56] References Cited

U.S. PATENT DOCUMENTS

| | | | |
|---|---|---|---|
| 4,093,889 | 6/1978 | Bloem et al. | 313/565 |
| 5,055,738 | 10/1991 | Yorifuji et al. | 313/490 |
| 5,204,584 | 4/1993 | Ikeda et al. | 313/565 |

*Primary Examiner*—Sandra L. O'Shea
*Assistant Examiner*—Joseph Williams
*Attorney, Agent, or Firm*—Walter M. Egbert, III

[57] ABSTRACT

A low-pressure mercury vapor discharge lamp according to the invention is provided with a discharge vessel (10) which encloses a discharge space (11) containing mercury and a rare gas in a gaslight manner. The discharge vessel (10) has a light-transmitting tubular portion (12) and a first and a second end portion (13A, 13B). Current supply conductors (20A, 20A'; 20B, 20B') issue through each end portion (13A, 13B) to respective electrodes (21A, 21B) arranged in the discharge space (11). The lamp is further provided with a main amalgam (30) for stabilizing the mercury vapour pressure in the discharge space (11) during normal operation, and with an auxiliary amalgam (31A, 31B) for quickly releasing mercury into the discharge space (11) after switching-on of the lamp. In an equilibrium state at room temperature (25° C.), the mass ($m_{Hg}$ in mg) of the quantity of mercury absorbed in auxiliary amalgam (31A, 31B) is at most 20 times the mercury vapour pressure ($P_E$ in Pa) prevalent in the discharge space (11) in the equilibrium state. Only comparatively small brightness differences between lamp zones occur in the lamp according to the invention after switching-on.

21 Claims, 2 Drawing Sheets

LOW PRESSURE MERCURY VAPOR DISCHARGE LAMP

Figure 1:
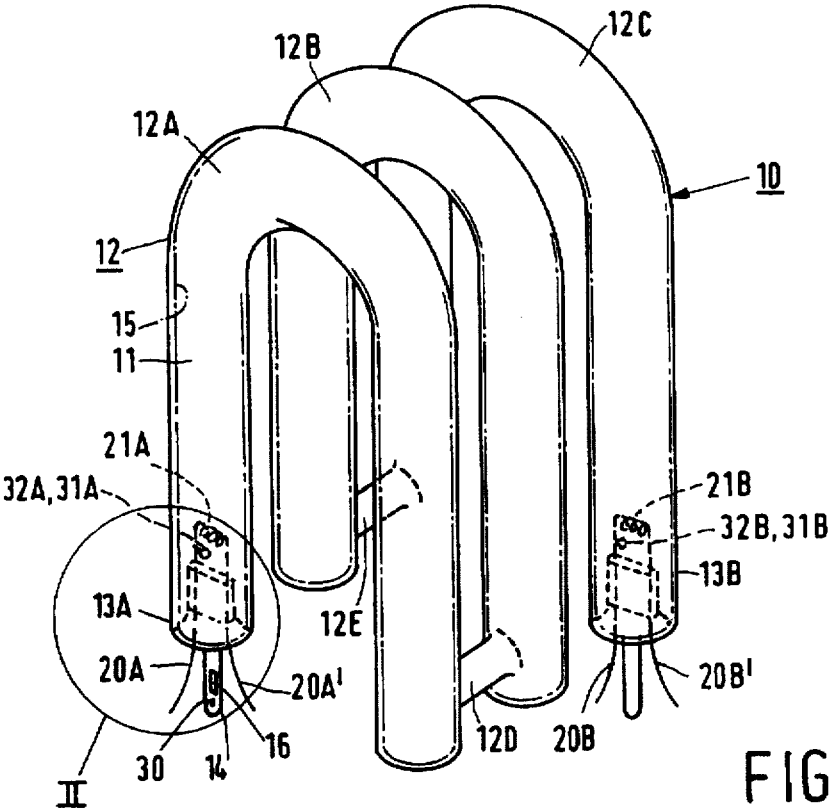

The invention relates to a low-pressure mercury vapour discharge lamp provided with a discharge vessel which encloses a discharge space containing mercury and a rare gas in a gastight manner, which discharge vessel has a light-transmitting tubular portion and a first and a second end portion, current supply conductors issuing through each of the end portions to respective electrodes arranged in the discharge space, which lamp is further provided with a main amalgam for stabilizing the mercury vapour pressure in the discharge space during nominal operation and with an auxiliary amalgam for quickly releasing mercury into the discharge space after switching-on of the lamp.

In a low-pressure mercury vapour discharge lamp of the kind described in the opening paragraph, the main amalgam must stabilize the mercury vapour pressure during operation around a value at which lamp operation is optimized, i.e. at a value for which the lumen output is as high as possible. The mercury released by the auxiliary amalgam after switching-on of the lamp accelerates the increase in the luminous intensity. After the lamp has been switched off, mercury diffuses from the main amalgam back to the auxiliary amalgam, an equilibrium state being approached after some time.

"Some new mercury alloys for use in fluorescent lamps", J. Bloem et al., Journal of the IES, pp. 141–147, April 1977, describes main amalgams for such lamps which control a comparatively high mercury vapour pressure at room temperature. The mercury vapour pressure controlled by an amalgam is understood to mean in the present description and claims the mercury vapour pressure accompanying an amalgam of the relevant composition. Room temperature is understood to be a temperature of 25° C. It is the object of the main amalgams proposed in said publication to accelerate the mercury absorption of the auxiliary amalgams and thus to improve further the increase in lumen output upon switching-on of the lamp. The cited publication further notes that indium is a usual amalgam-forming metal for use as an auxiliary amalgam because it has a low mercury vapour pressure.

A lamp of the kind described in the opening paragraph is commercially available. The known lamp is integrated with a supply unit into a lighting unit and is designed for use as a replacement for incandescent lamps. The tubular portion of the discharge vessel comprises three U-shaped segments which are interconnected by channels. Fastened to an end portion of the discharge vessel there is an exhaust tube in which a main amalgam is accommodated, here an amalgam of 180 mg of the alloy $Pb_{16}Bi_{36}Sn_{48}$ with 5.3 mg Hg. This notation in the present description with a number behind each element indicates the atomic percentage of the relevant element in the alloy. A strip of CrNi steel coated with 1.2 mg indium forming auxiliary amalgam is fastened to one of the current supply conductors to each electrode. After switching-on of the lamp, the strip temperature rises quickly because it is heated by the electrode.

The known lamp has the disadvantage that the outer segments form comparatively bright zones compared with the central segment up to a few minutes after switching-on.

It is an object of the invention to provide a measure in a lamp of the kind described in the opening paragraph which reduces brightness differences between the zones of the discharge vessel in the period following switching-on.

According to the invention, the lamp of the kind described in the opening paragraph is for this purpose characterized in that in an equilibrium state at room temperature the mass (in mg) of the quantity of mercury absorbed in auxiliary amalgam amounts to at most 20 times the mercury vapour pressure prevalent in the discharge space in the equilibrium state (equilibrium mercury vapour pressure expressed in Pa).

The inventors have found that the known lamp, when in daily use, remains switched off for too short a period for approaching the equilibrium state. The auxiliary amalgams have absorbed so little mercury compared with the quantity they contain in the equilibrium state when the lamp has been out of action for a day or shorter that the vapour pressure controlled by the auxiliary amalgams is still low in comparison with the equilibrium mercury vapour pressure. It was also found that the mercury vapour pressure controlled by the auxiliary amalgams in the off-state and at the moment of switching-on determines the mercury vapour pressure in the discharge space to an important degree, so that the initial light output of the lamp, i.e. the light 1 second after ignition, is comparatively low.

It is true that the auxiliary amalgams quickly release mercury vapour upon switching-on of the lamp, so that zones situated close to the auxiliary amalgams, in the known lamp the outer segments, experience a quick rise in the lumen output. It takes a comparatively long time, however, before the mercury thus released has spread through the entire discharge space and has been able to raise the lumen output also in the central segment of the discharge vessel.

In the lamp according to the invention, the mass of the mercury absorbed in the auxiliary amalgam in the equilibrium state at room temperature is comparatively small, so that the equilibrium state is comparatively quickly approximated after switching-off of the lamp. The mercury vapour pressure controlled by auxiliary amalgam in the off-state accordingly rises comparatively quickly. A comparatively high mercury vapour pressure is prevalent already in the entire discharge space at the moment of switching-on of the lamp, so that the initial lumen output is comparatively high. It was found that the brightness differences between the lamp zones are comparatively inconspicuous under these circumstances.

Those skilled in the art can ascertain by simple experiments how the mercury vapour pressure of an amalgam changes as a function of the mass percentage of the mercury present therein. They can accordingly determine what is the maximum allowable mass of the alloy from which the amalgam is formed in order to make the mass of the mercury absorbed therein in the equilibrium state at room temperature smaller than 20 times the equilibrium mercury vapour pressure. In the case of a comparatively hard amalgam, which still controls a low mercury vapour pressure at a comparatively high mercury content, the maximum admissible quantity of the alloy is smaller than in the case of a comparatively soft amalgam, which already controls a high mercury vapour pressure at a comparatively low mercury content. The mass (in mg) of the mercury absorbed in auxiliary amalgam in the equilibrium state is preferably greater than 0.002 times the product of the equilibrium mercury vapour pressure (in Pa) and the volume of the discharge vessel (in $cm^3$). The lumen output after switching-on of the lamp rises comparatively slowly in the case of a smaller mass, for example, a mass of 0.001 time said product.

The lamp according to the invention may have more than one auxiliary amalgam. The quantity of mercury absorbed in auxiliary amalgam in that case is understood to be the quantity of mercury absorbed in the auxiliary amalgams together. The lamp according to the invention has, for example, an auxiliary amalgam at each end portion. In a modification, for example, a first auxiliary amalgam is fastened to a current supply conductor at each end portion, and a second auxiliary amalgam is fastened to the wall of the discharge vessel adjacent the electrode. Alternatively, an auxiliary amalgam may be positioned centrally in the discharge space, so that it is heated by the heat generated in the discharge. The lamp may have one or several further main amalgams. For example, a main amalgam is accommodated in an exhaust tube at each end portion of the discharge vessel.

It is noted that an electrodeless low-pressusre mercury vapour discharge lamp is commercially available which is provided with a pear-shaped discharge vessel of 110 mm diameter which has a recess in which a coil provided with an electrically conducting winding is accommodated. A high-frequency magnetic field is generated by means of the coil during operation, maintaining a discharge. The lamp has a main amalgam of 180 mg of the alloy $Bi_{56}In_{44}$ and an auxiliary amalgam of 0.1 mg In, 5.5 mg Hg being dosed. The mass of the mercury absorbed in the auxiliary amalgam is approximately three times the equilibrium mercury vapour pressure in the equilibrium state at room temperature. In this lamp, in which the distance from the auxiliary amalgam to the point within the discharge space fartherst removed therefrom is comparatively small, however, the mercury released by the auxiliary amalgam can spread so quickly within the discharge space that local brightness differences are not conspicuous also in the case of a low initial lumen output.

It is further noted that lamps are known from U.S. Pat. No. 5,204,584 about which it is stated that the mercury vapour pressure of the auxiliary amalgam is at least one third of, and smaller than the mercury vapour pressure of the main amalgam. No indications on the auxiliary amalgam follow from this, however, because the mercury vapour pressure of each auxiliary amalgam varies from negligibly small shortly after switching-off, when the auxiliary amalgam has cooled down, to a value equal to the mercury vapour pressure of the main amalgam in the equilibrium state. Although specific combinations of main and auxiliary amalgams are mentioned, the mass of the auxiliary amalgams, and thus the mass of the quantity of mercury absorbed in auxiliary amalgam in the equilibrium state, is not known from this patent document.

When the lamp has cooled down after switching-off, the mercury vapour pressure controlled by the auxiliary amalgam initially rises uninterruptedly because it absorbs mercury which diffuses to it from the main amalgam. Once the auxiliary amalgam has absorbed so much mercury that it has reached its coexistence region, in which the solid phase and the liquid phase of the amalgam exist side by side, the mercury vapour pressure controlled by the auxiliary amalgam is substantially independent of the mercury content. It is not until the auxiliary amalgam has become completely liquid that a significant rise in the mercury vapour pressure can occur again.

An attractive embodiment of the lamp according to the invention is accordingly characterized in that the mercury vapour pressure in the coexistence region of the auxiliary amalgam is approximately equal to or higher than the equilibrium mercury vapour pressure at room temperature. In this embodiment of the lamp according to the invention, the rise in the mercury vapour pressure in the discharge vessel after switching-off of the lamp is at least not substantially hampered by the properties of the auxiliary amalgam in the coexistence region.

If there is a small positive difference between the equilibrium mercury vapour pressure and the mercury vapour pressure in the coexistence region of the auxiliary amalgam, the mercury vapour pressure will rise comparatively quickly to the mercury vapour pressure level of the coexistence region. After that, however, the auxiliary amalgam continues absorbing mercury slowly and for a longer period as a result of the small positive vapour pressure difference. An embodiment of the lamp according to the invention is accordingly preferred wherein the mercury vapour pressure in the coexistence region of the auxiliary amalgam at said temperature is higher than the equilibrium mercury vapour pressure. When the mercury vapour pressure controlled by the auxiliary amalgam approximates the equilibrium mercury vapour pressure, it has approximately absorbed the quantity of mercury which it contains in the equilibrium state.

The auxiliary amalgam may be provided, for example, on a gauze strip which is fastened to a current supply conductor to the electrode. In an advantageous embodiment of the low-pressure mercury vapour discharge lamp according to the invention, the auxiliary amalgam is surrounded by an open housing. The housing counteracts the effect that material of the auxiliary amalgam is sputtered away during lamp operation.

A favourable embodiment of the low-pressure mercury vapour discharge lamp according to the invention is characterized in that the main amalgam has a critical temperature of at least 70° C. The term "critical temperature" in the present description and claims is understood to be the highest temperature of the main amalgam at which the solid and liquid phases coexist. A main amalgam with a critical temperature above 70° C. is allowed to assume a comparatively high temperature during operation, which facilitates lamp design.

Favourable results were obtained with a low-pressure mercury vapour discharge lamp according to the invention which is characterized in that the main amalgam is formed from an alloy of PbBiSn, and the auxiliary amalgam is formed from one of the alloys from the group SnPb and PbBiSn.

Favourable results were also obtained with a low-pressure mercury vapour discharge lamp according to the invention which is characterized in that the main amalgam is formed from an alloy of BiIn, and the auxiliary amalgam is formed from one of the alloys from the group SnPb and PbBiSn and BiIn.

Figure 2:
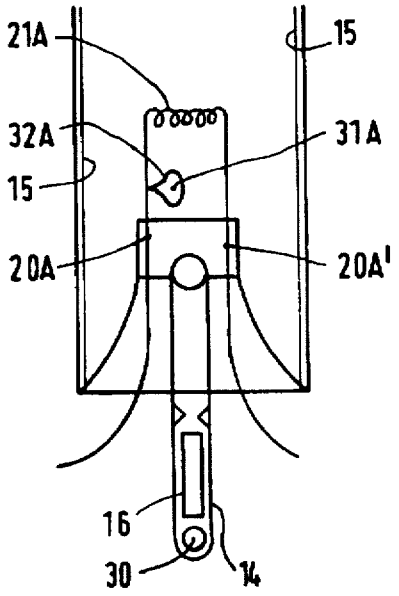
Figure 3:
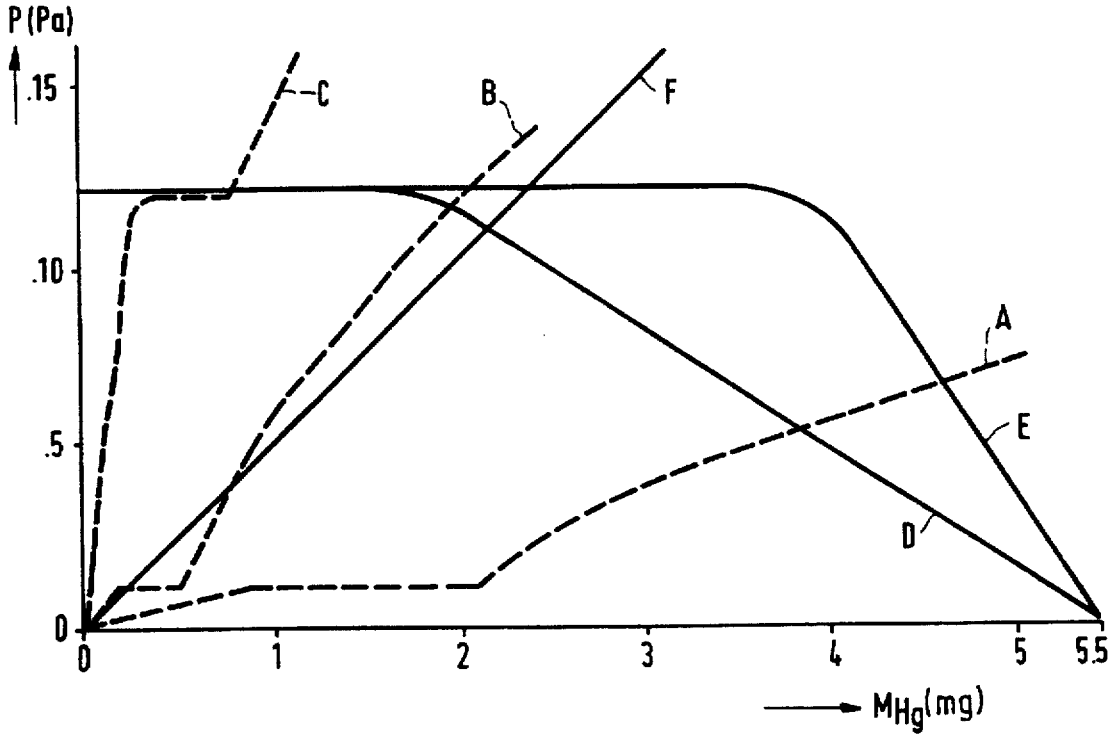

This and other aspects of the lamp according to the invention will be explained in more detail with reference to the drawing. FIG. 1 therein shows an embodiment of a lamp according to the invention. FIG. 2 shows a portion of the lamp corresponding to detail II in FIG. 1 in longitudinal sectional view. FIG. 3 represents the relation between the mass of the mercury absorbed in the auxiliary amalgam in mg and the mercury vapour pressure in Pa.

The low-pressure mercury vapour discharge lamp shown in FIG. 1 is provided with a discharge vessel 10 which encloses a discharge space 11 containing mercury and a rare gas in a gastight manner. The discharge vessel here contains a mixture of 75% argon by volume and 25% neon by volume with a filling pressure of 400 Pa. The discharge vessel 10 is formed from a light-transmitting tubular portion 11 of lime glass comprising three U-shaped segments 12A, 12B, 12C with a total length of 46 cm and an internal diameter of 10 mm and closed off by end portions 13A, 13B. The segments 12A, 12B and 12C are interconnected by channels 12D, 12E. The tubular portion 12 has a luminescent layer 15 at an inner surface. The discharge vessel 10 has a volume V of approximately 36 $cm^3$. Current supply conductors 20A, 20A'; 20B, 20B' issue through each end portion 13A, 13B to a respective electrode 21A, 21B arranged in the discharge space 11. A main amalgam 30 for stabilization of the mercury vapour pressure during nominal operation in the discharge space 11 is positioned in an exhaust tube 14 which is connected to an end portion 13A and which is in communication with the discharge space 11 (see also FIG. 2). A glass rod 16 of 11 mm length, which is accommodated with lateral clearance in the exhaust tube 14, keeps the main amalgam 30 spaced away from the end portion 13A. A steel housing 32A, 32B is fastened to one current supply conductor 20A, 20B of each electrode 21A, 21B, in which housing an auxiliary amalgam 31A, 31B is accommodated. The housing 32A, 32B has four openings of 0.1 mm diameter. The radiant heat from the electrodes 21A, 21B causes the housing 32A, 32B with the auxiliary amalgam 31A, 31B to rise in temperature quietly after switching-on of the lamp, so that mercury vapour is released into the discharge space 11. In an alternative embodiment, an auxiliary amalgam may be aged, for example, in the discharge path between the electrodes. The auxiliary amalgam is heated by heat generated in the discharge in that case.

To investigate the influence of the quantity and type of the auxiliary amalgam on the discernibility of brightness differences between lamp zones, lamps (II) according to the invention were manufactured in which the auxiliary amalgams 31A, 31B each contained 0.3 mg indium. Furthermore, lamps (III) according to the invention were manufactured with 2.5 mg $Pb_{16}Bi_{36}Sn_{48}$ for each auxiliary amalgam 31A, 31B. For comparison, lamps (I) not according to the invention were manufactured containing auxiliary amalgams with 1.2 mg indium. The main amalgam is formed from the alloy $Pb_{16}Bi_{36}Sn_{48}$ and 5.5 mg mercury is dosed both in the lamps (II, III) according to the invention and in the lamps (I) not according to the invention. One or several lamps were made of each type (I, II, III) in which the mass ($M_l$) of the alloy from which the main amalgam is formed is 72 mg, and one or several in which the alloy has a mass ($M_l$) of 33 mg. The critical temperature of the main amalgam is approximately 80° C. in both cases.

The above lamps were subjected to an endurance test of 100 hours. After having been out of operation for 24 hours, the lamps were switched on again and the initial lumen output ($\Phi_{1s}$) was measured. The initial lumen output ($\Phi_{1s}$) is shown in the Table as a percentage of the lumen output during optimum operation. The lumen output after 1 minute of operation of the lamp is also shown ($\Phi_{1m}$), also as a percentage of the lumen output value during optimum operation. N in the Table indicates the number of lamps of the same type. If the lumen output was measured for more than one lamp of the same type, the Table contains the avenge value. The Table also contains the equilibrium mercury vapour pressure ($P_E$), the mass of the quantity of mercury absorbed in auxiliary amalgam in the equilibrium state ($m_{Hg}$), the maximum quantity of mercury to be absorbed in auxiliary amalgam in the equilibrium state according to the invention ($20 \times P_E$), and the mercury vapour pressure ($P_C$) in the coexistence region of the auxiliary amalgam.

| Aux. amalgam | $M_L$ (mg) | $P_E$ (Pa) | $m_{Hg}$ (mg) | $20*P_E$ (mg) | $P_C$ (Pa) | $\Phi_{1s}$ (%) | $\Phi_{1m}$ (%) | N |
|---|---|---|---|---|---|---|---|---|
| I In | 33 | 0.060 | 4.29 | 1.20 | 0.016 | 14 | 75 | 2 |
| 2 × 1.2 mg | 72 | 0.044 | 3.67 | 0.88 | 0.016 | 11 | 74 | 2 |

-continued

| Aux. amalgam | $M_L$ (mg) | $P_E$ (Pa) | $m_{Hg}$ (mg) | $20*P_E$ (mg) | $P_C$ (Pa) | $\Phi_{1s}$ (%) | $\Phi_{1m}$ (%) | N |
|---|---|---|---|---|---|---|---|---|
| II In | 33 | 0.12 | 1.90 | 2.40 | 0.016 | 25 | 72 | 3 |
| 2 × 0.3 mg | 72 | 0.11 | 2.08 | 2.20 | 0.016 | 22 | 73 | 1 |
| III | 33 | 0.12 | 0.71 | 2.40 | 0.12 | 30 | 75 | 3 |
| $Pb_{16}Bi_{36}Sn_{48}$ 2 × 2.5 mg | 72 | 0.12 | 0.34 | 2.40 | 0.12 | 28 | 74 | 2 |

The mass of the mercury absorbed in auxiliary amalgam is greater than 0.002 times the product of the equilibrium mercury vapour pressure ($P_E$) and the volume (V) of the discharge space in all cases.

The lamps according to the invention, in which the mass of the mercury absorbed in auxiliary amalgam in the equilibrium state is smaller than 20 times the equilibrium vapour pressure, have a comparatively high initial lumen output ($\Phi_{1s}$) also after a comparatively short time of non-operation in comparison with the lamps not according to the invention in which said mass ($m_{Hg}$) is more than 20 times the equilibrium vapour pressure ($P_E$). The brightness differences between the various lamp zones were found to be much smaller in lamps according to the invention (II, III) than in lamps not according to the invention (I). The best results were obtained with the lamps of type III. The lumen output after one minute of operation ($\Phi_{1m}$) of the lamps according to the invention (II, III) is comparable to that of the lamps not according to the invention (I).

FIG. 3 shows the mercury vapour pressure ($P_{Hg}$) of the amalgams used as a function of the mass ($m_{Hg}$) of the quantity of mercury absorbed in auxiliary amalgam at room temperature. The mass ($m_{Hg}$) of the quantity of mercury absorbed in auxiliary amalgam corresponds approximately to the mass of the mercury derived from the main amalgam, since the mass of free mercury is negligibly small. Curves A, B and C (broken lines) represent the mercury vapour pressure of the auxiliary amalgams in lamps A, B and C, respectively. Curves D and E show the mercury vapour pressures of the main amalgam formed from 72 mg and 33 mg of the alloy $Pb_{16}Bi_{36}Sn_{48}$, respectively. Curve F indicates the relation between the mass of the maximum quantity of mercury to be absorbed in auxiliary amalgam and the equilibrium mercury vapour pressure. It is apparent from FIG. 3 that the auxiliary amalgams in the lamps according to the invention contain little mercury in the equilibrium state compared with lamps not according to the invention. In the lamp according to the invention, therefore, the auxiliary amalgams control a comparatively high mercury vapour pressure already after having absorbed a comparatively small quantity of mercury, so that the mercury vapour pressure in the discharge space facilitates a comparatively high initial lumen output after a comparatively short off-time of the lamp already.

In the lamp acording to the invention containing auxiliary amalgam B, the mercury vapour pressure ($P_C$) in the coexistence region is much lower than the equilibrium mercury vapour pressure ($P_E$). In that case, the mercury vapour pressure remains at the value which the mercury vapour pressure has in the coexistence region of the auxiliary amalgam, i.e. approximately 0.016 Pa, for some time after switching-off of the lamp. An uninterrupted rise in the mercury vapour pressure occurs in the lamp according to the invention with auxiliary amalgam C after the lamp has cooled down after switching-off. In this case, the mercury vapour pressure ($P_C$) in the coexistence region is approximately the same as the equilibrium mercury vapour pressure ($P_E$).

Two groups of lamps (IV, V) were manufactured for a next experiment, where the filling was provided with 2.5 mg mercury and the main amalgam was formed from 45 mg of the alloy $Bi_{56}In_{44}$. The main amalgam thus formed has a critical temperature of approximately 105° C. Auxiliary amalgams, one at each lamp end portion, were formed from 5 mg of the alloy $Bi_{56}In_{44}$ (IV) and $Pb_{16}Bi_{36}Sn_{48}$ (V) in the two respective groups. The lamps correspond to the lamps of FIG. 1, except for the choice of amalgams.

| auxiliary amalgam | $P_E$ (Pa) | $m_{Hg}$ (mg) | $20*P_E$ (mg) | $\Phi_{1s}$ (%) | $\Phi_{1m}$ (%) | N |
|---|---|---|---|---|---|---|
| IV $Bi_{56}In_{44}$ | 0.10 | 0.42 | 2.0 | 20.5 | 59.9 | 4 |
| V $Pb_{16}Bi_{36}Sn_{48}$ | 0.11 | 0.10 | 2.2 | 19.6 | 67.5 | 6 |

It is apparent again that the lamps according to the invention (IV, V) have a comparatively high initial lumen output ($\Phi_{1s}$). The brightness differences between the lamp zones after switching-on of the lamp are small. The mercury vapour pressure ($P_C$) controlled by the auxiliary amalgam in the coexistence region is approximately equal to the equilibrium mercury vapour pressure ($P_E$) in the lamps of group IV. In the lamp of group V, the mercury vapour pressure controlled by the auxiliary amalgam in the coexistence region is higher than the equilibrium mercury vapour pressure ($P_E$). It holds for these lamps that, when the vapour pressure controlled by the auxiliary amalgam has come close to the equilibrium mercury vapour pressure, the auxiliary amalgams have absorbed approximately the quantity of mercury which they contain in the equilibrium state. In all cases, the increase in the mercury vapour pressure controlled by the auxiliary amalgam in the period during which the lamp was out of operation has not been retarded by the position of the coexistence region.

Ten lamps according to the invention were also made in which an auxiliary amalgam was used formed from the alloy $Sn_{74}Pb_{26}$. A gauze strip provided with 5 mg of said alloy was for this purpose fastened on a current supply conductor to each electrode. The mass of the mercury absorbed in the auxiliary amalgam formed from this alloy in the equilibrium state is of the same order of magnitude as or smaller than that of the auxiliary amalgam formed from the alloy $Pb_{16}Bi_{36}Sn_{48}$, given equal masses of the auxiliary amalgams. Five out of the ten lamps had a main amalgam of 60 mg of the alloy $Pb_{16}Bi_{36}Sn_{48}$, and 2.5 mg mercury was dosed. The other five lamps had a main amalgam of 45 mg of the alloy $Bi_{56}In_{44}$, again 2.5 mg mercury being dosed. Apart from the above, the ten lamps correspond to the lamps of FIG. 1. The initial lumen output ($\Phi_{1s}$) of the first group of five lamps was 21%. The initial lumen output of the second group was 20%. The lumen output after one minute was 72% for both groups of lamps. These lamps also showed only small brightness differences between lamp zones after switching-on.

We claim:

1. A low-pressure mercury vapour discharge lamp provided with a discharge vessel (10) which encloses a discharge space (11) containing mercury and a rare gas in a gastight manner, which discharge vessel (10) has a light-transmitting tubular portion (12), and a first and a second end portion (13A,13B), current supply conductors (20A, 20A'; 20B,20B') issuing through each of the end portions (13A, 13B) to respective electrodes (21A,21B) arranged in the discharge space (11), which lamp is further provided with a main amalgam (30) for stabilizing the mercury vapour pressure in the discharge space (11) during nominal operation and with an auxiliary amalgam (31A,31B) for quickly releasing mercury into the discharge space (11) after switching-on of the lamp, characterized in that in an equilibrium state at room temperature the mass (in mg) of the quantity of mercury absorbed in auxiliary amalgam (31A, 31B) amounts to at most 20 times the mercury vapour pressure ($P_E$ in Pa) prevalent in the discharge space (11) in the equilibrium state.

2. A low-pressure mercury vapour discharge lamp as claimed in claim 1, characterized in that the mercury vapour pressure ($P_C$) in the coexistence region of the auxiliary amalgam (31A,31B) is approximately equal to or higher than the equilibrium mercury vapour pressure ($P_E$) at room temperature.

3. A low-pressure mercury vapour discharge lamp as claimed in claim 1, characterized in that the mercury vapour pressure ($P_C$) in the coexistence region of the auxiliary amalgam (31A,31B) is higher than the equilibrium mercury vapour pressure ($P_E$) at room temperature.

4. A low-pressure mercury vapour discharge lamp as claimed in claim 3, characterized in that the auxiliary amalgam (31A,31B) is surrounded by an open housing (32A,32B).

5. A low-pressure mercury vapour discharge lamp as claimed in claim 4, characterized in that the main amalgam (30) has a critical temperature of at least 70° C.

6. A low-pressure mercury vapour discharge lamp as claimed in claim 5, characterized in that the main amalgam (30) is formed from an alloy of PbBiSn, and the auxiliary amalgam (31A,31B) is formed from one of the alloys from the group SnPb and PbBiSn.

7. A low-pressure mercury vapour discharge lamp as claimed in claim 5, characterized in that the main amalgam (30) is formed from an alloy of BiIn, and the auxiliary amalgam (31A,31B) is formed from one of the alloys from the group SnPb and PbBiSn and BiIn.

8. A low-pressure mercury vapour discharge lamp as claimed in claim 4, characterized in that the main amalgam (30) is formed from an alloy of BiIn, and the auxiliary amalgam (31A,31B) is formed from one of the alloys from the group SnPb and PbBiSn and BiIn.

9. A low-pressure mercury vapour discharge lamp as claimed in claim 3, characterized in that the main amalgam (30) is formed from an alloy of BiIn, and the auxiliary amalgam (31A,31B) is formed from one of the alloys from the group SnPb and PbBiSn and BiIn.

10. A low-pressure mercury vapour discharge lamp as claimed in claim 2, characterized in that the main amalgam (30) is formed from an alloy of BiIn, and the auxiliary amalgam (31A,31B) is formed from one of the alloys from the group SnPb and PbBiSn and BiIn.

11. A low-pressure mercury vapour discharge lamp as claimed in claim 1, characterized in that the main amalgam (30) is formed from an alloy of BiIn, and the auxiliary amalgam (31A,31B) is formed from one of the alloys from the group and PbBiSn and BiIn.

12. A low-pressure mercury vapour discharge lamp as claimed in claim 4, characterized in that the main amalgam (30) is formed from an alloy of PbBiSn, and the auxiliary amalgam (31A,31B) is formed from one of the alloys from the group SnPb and PbBiSn.

13. A low-pressure mercury vapour discharge lamp as claimed in claim 3, characterized in that the main amalgam (30) is formed from an alloy of PbBiSn, and the auxiliary amalgam (31A,31B) is formed from one of the alloys from the group SnPb and PbBiSn.

14. A low-pressure mercury vapour discharge lamp as claimed in claim 2, characterized in that the main amalgam

(30) is formed from an alloy of PbBiSn, and the auxiliary amalgam (31A,31B) is formed from one of the alloys from the group SnPb and PbBiSn.

15. A low-pressure mercury vapour discharge lamp as claimed in claim 1, characterized in that the main amalgam (30) is formed from an alloy of PbBiSn, and the auxiliary amalgam (31A,31B) is formed from one of the alloys from the group SnPb and PbBiSn.

16. A low-pressure mercury vapour discharge lamp as claimed in claim 2, characterized in that the auxiliary amalgam (31A,31B) is surrounded by an open housing (32A,32B).

17. A low-pressure mercury vapour discharge lamp as claimed in claim 16, characterized in that the main amalgam (30) is formed from an alloy of PbBiSn, and the auxiliary amalgam (31A,31B) is formed from one of the alloys from the group SnPb and PbBiSn.

18. A low-pressure mercury vapour discharge lamp as claimed in claim 16, characterized in that the main amalgam (30) is formed from an alloy of BiIn, and the auxiliary amalgam (31A,31B) is formed from one of the alloys from the group SnPb and PbBiSn and BiIn.

19. A low-pressure mercury vapour discharge lamp as claimed in claim 1, characterized in that the auxiliary amalgam (31A,31B) is surrounded by an open housing (32A,32B).

20. A low-pressure mercury vapour discharge lamp as claimed in claim 19, characterized in that the main amalgam (30) is formed from an alloy of PbBiSn, and the auxiliary amalgam (31A, 31B) is formed from one of the alloys from the group SnPb and PbBiSn.

21. A low-pressure mercury vapour discharge lamp as claimed in claim 19, characterized in that the main amalgam (30) is formed from an alloy of BiIn, and the auxiliary amalgam (31A,31B) is formed from one of the alloys from the group SnPb and PbBiSn and BiIn.

* * * * *